US006236380B1

(12) United States Patent
Wani et al.

(10) Patent No.: US 6,236,380 B1
(45) **Date of Patent: *May 22, 2001**

(54) METHOD FOR DISPLAYING GRADATION WITH PLASMA DISPLAY PANEL

(75) Inventors: Koichi Wani, Osaka; Naoki Kosugi, Kyoto; Takao Wakitani, Osaka, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/110,802

(22) Filed: Jul. 6, 1998

(30) Foreign Application Priority Data

Jul. 7, 1997 (JP) ..... 9-181059

(51) Int. Cl.[7] ..... G09G 3/22

(52) U.S. Cl. ..... 345/60; 345/63; 345/68; 345/90; 345/147; 345/204; 348/797; 315/169.4

(58) Field of Search ..... 345/60, 63, 68, 345/90, 147, 209; 348/797; 315/169.4

(56) References Cited

U.S. PATENT DOCUMENTS

| | | | | |
|---|---|---|---|---|
| 5,049,865 | * | 9/1991 | Nakamura et al. | 345/60 |
| 5,436,634 | * | 7/1995 | Kanazawa | 345/67 |
| 5,475,448 | * | 12/1995 | Saegusa | 348/797 |
| 5,508,716 | * | 4/1996 | Prince et al. | 345/103 |
| 5,541,618 | | 7/1996 | Shinoda . | |
| 5,724,054 | * | 3/1998 | Shinoda | 345/60 |
| 5,734,365 | * | 3/1998 | Ohno et al. | 345/97 |
| 5,818,419 | * | 10/1998 | Tajima et al. | 345/147 |
| 5,874,932 | * | 2/1999 | Nagaoka et al. | 345/60 |

FOREIGN PATENT DOCUMENTS

| | | |
|---|---|---|
| 0 488 326 | 6/1992 | (EP) . |
| 0 488 891 | 6/1992 | (EP) . |
| 0 755 043 | 1/1997 | (EP) . |

OTHER PUBLICATIONS

1984, Hiroshi Murakami et al., "A Color TV Display Using 8–Inch Pulse Discharge Panel with Internal Memory" *Japan Television Institute Memoir* vol. 38, No. 9, pp. 836–842 (with English translation).

1973, Tetsunori Kaji et al., "A Proposal of the Drive Method for TV using AC type Plasma Display Panel" *Institute of Electronics and Communication Engineers* IT 72–45 (with English translation).

* cited by examiner

*Primary Examiner*—Bipin Shalwala
*Assistant Examiner*—Vincent E. Kovalick
(74) *Attorney, Agent, or Firm*—Merchant & Gould P.C

(57) ABSTRACT

A method for displaying an image with gradation and a high brightness with a plasma display panel is provided. In this method, one field is divided into eight subfields, and each subfield is divided into an addressing period and sustaining period. In the upper four bits $b_4$, $b_5$, $b_6$, and $b_7$, in which the sustaining period is long, all of the scanning electrodes are scanned sequentially. In the lower four bits $b_0$, $b_1$, $b_2$ and $b_3$, in which the sustaining period is short, the scanning electrodes are scanned alternately by interlace scanning.

8 Claims, 8 Drawing Sheets

METHOD FOR DISPLAYING GRADATION WITH PLASMA DISPLAY PANEL

BACKGROUND OF THE INVENTION

1. Field of the Invention

This invention relates to a method for displaying gradation with a plasma display panel (hereinafter referred to as"PDP").

2. Description of the Related Art

One such method is disclosed, for example, in the paper of the image engineering study group of The Institute of Electronics, Information and Communication Engineers, IT 72-45 (1973). In this paper, the gradation display is performed by time-dividing a field of an image into a plurality of subfields, and giving a proper weight on a luminescent period in each subfield. Thus, a linear gradation characteristic is obtained by altering a luminescent period to display a halftone in a PDP, which utilizes a discharge luminescence and in which a current or a voltage is not proportional to a luminescence.

FIG. 7 shows an example of a conventional method for displaying gradation with a PDP disclosed in JP-A-4-195188. In this method, a subfield is further divided into an addressing period and a sustaining period. In the addressing period, a binary data, i.e., on or off is written into every pixel by noninterlace scanning in which all scanning electrodes are selected sequentially. In the sustaining period following the addressing period, all pixels that have been given the on data are held emitting light for a predetermined period to display an image in a binary gradation.

Furthermore, the weight given to the sustaining period of each subfield, i.e., a ratio of the sustaining periods may be set 1, 2, 4, 8 . . . , $2^{n-1}$ (n is a number of subfields) and all images in the subfields included in a field may be accumulated in eyes of a viewer. Thus, an image can be displayed in 64 gradation steps when n =6, or in 256 gradation steps when n =8.

FIG. 8 shows another example of a conventional method for displaying gradation disclosed in Japan Television Institute Memoir Vol. 38, No. 9 (1984). In this method, one field is divided into a plurality of subfields in the same way as the above-mentioned method shown in FIG. 7. However, the method shown in FIG. 8 starts the sustaining period immediately after selecting one of the scanning electrodes to write data into it. This operation is different from the method shown in FIG. 7. The next scanning electrode to be selected is given data by utilizing a stop period for the light emitting pulse. The sustaining period of each subfield is given weight $2^{m-1}$ (m =1, 2 . . . , n) for example in the same way as the example shown in FIG. 7.

By such a method for displaying gradation, a PDP can display an image with a sufficient number of gradation levels, and it has attracted attention as realizing a so-called wall-hung TV or a flat TV in recent years.

However, the above mentioned method has the following disadvantage. The majority of the time is used for the addressing period for writing data and the sustaining period is too short to obtain a sufficient brightness of the PDP. The current mainstream is a surface discharge AC type PDP, which needs a period of approximately 2.5 microseconds for selecting a scanning electrode and writing data. In this case, if a PDP having 500 scanning electrodes is driven with 8-subfield division, the addressing period is 10 milliseconds (2.5 microseconds ×500 ×8). Therefore, only 6.7 milliseconds remain for the sustaining period in one field (16.7 milliseconds). As a result, the brightness of a PDP may be insufficient in the method of the prior art.

SUMMARY OF THE INVENTION

In order to solve the above mentioned problem of the prior art, the present invention provides a method for displaying gradation with a PDP, which comprises the steps of forming a field to include a whole scanning subfield and a partial scanning subfield, each of which includes an addressing period to scan scanning electrodes sequentially for writing image data and a sustaining period to hold the written image data, scanning all of the scanning electrodes one by one in the addressing period of the whole scanning subfield, and scanning some of the scanning electrodes in the addressing period of the partial scanning subfield.

Another displaying method of the present invention comprises steps of forming a field to include a whole scanning subfield and a quasi-whole scanning subfield, each of which includes an addressing period to scan scanning electrodes sequentially for writing image data and a sustaining period to hold the written image data, scanning all of the scanning electrodes one by one in the addressing period of the whole scanning period, and scanning all of the electrodes in a short time by selecting two neighboring scanning electrodes simultaneously in the addressing period of the quasi-whole scanning subfield.

According to each of the methods mentioned above, the addressing period can be shortened to expand the sustaining period by using an interlace scanning, and the flicker due to the interlace scanning can be suppressed.

It is preferable that the odd or even numbered scanning electrodes are scanned in the partial scanning subfield, supposing that each of the scanning electrodes has a number corresponding to the order of the arrangement. Similarly in the second method, data corresponding to the scanning electrode with either an odd number or an even number are written in the quasi-whole scanning subfield again supposing that the scanning electrodes are sequentially arranged It is also preferable that the partial scanning subfield in which the odd numbered scanning are scanned and the partial scanning subfield in which the even numbered scanning electrodes are scanned appear alternately. Similarly it is preferable in the second method, that the quasi-whole scanning subfield in which the data corresponding to the odd numbered scanning electrode are written and the quasi-whole scanning subfield in which the data corresponding to the even numbered scanning electrode are written appear alternately.

DESCRIPTION OF THE PREFERRED EMBODIMENTS

The present invention is now explained in detail using examples with reference to the drawings.

EXAMPLE 1

Figure 1:
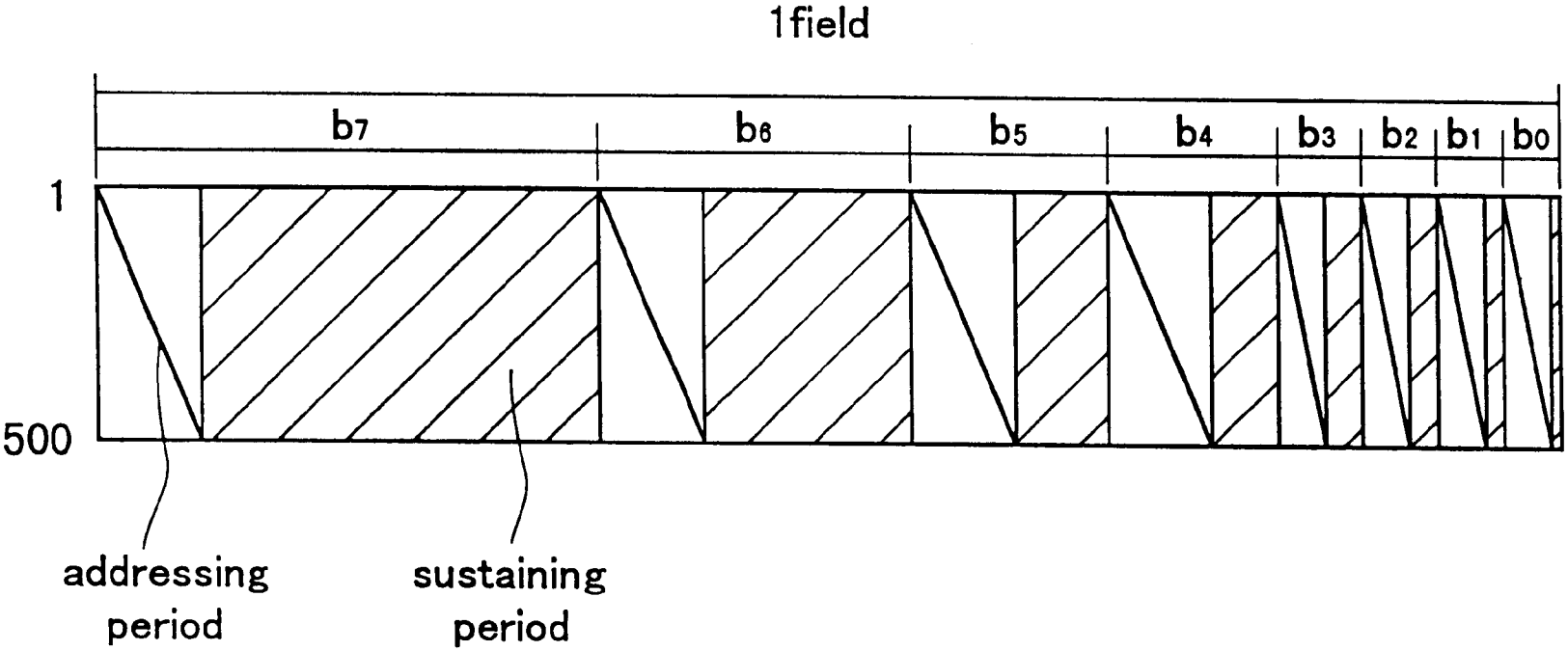
FIG. 1 is a time chart showing an example of the method for displaying gradation according to the present invention.

FIG. 1 shows a timing chart of an example of the method for displaying gradation according to the present invention. This example uses a PDP that has 500 scanning electrodes and realizes 256 levels of gradation. In FIG. 1, the vertical direction corresponds to the number of the scanning electrode, and the horizontal direction corresponds to time. A field is divided into eight subfields, and each of the subfields includes an addressing period and a sustaining period (i.e., a light emitting period). The sustaining period of each subfield is given a weight of 128, 64, 32, 16, 8, 4, 2 or 1 corresponding to an 8-bit digital signal ($b_7$, $b_6$, $b_5$, $b_4$, $b_3$, $b_2$, $b_1$, and $b_0$) generated by analog-digital (A/D) conversion of an image signal. In the addressing period, the scanning electrodes are scanned and data writing is performed. The scanning electrodes are selected alternately. Thus, an interlace scanning is performed in which half of the scanning electrodes are selected to shorten the addressing period.

However, if the interlace scanning is performed in every subfield, a flicker may occur in the image. The inventors studied partial interlace scanning in which the interlace scanning is performed only in subfields corresponding to lower bits that have a short sustaining period and a small contribution to the brightness. As a result of the experiment, it was found that the flicker hardly occurs when addressing the subfield corresponding to the lower four bits $b_0$, $b_1$, $b_2$ and $b_3$ whose weights in the sustaining period are 1, 2, 4 and 8 (i.e., the partial scanning subfield) by the interlace scanning, and addressing the upper four bits $b_4$, $b_5$, $b_6$ and $b_7$ whose weights in the sustaining period are 16, 32, 64 and 128 (i.e., the whole scanning subfield) by the non-interlace scanning.

The above-mentioned addressing method substantially shortens the addressing time in one field compared with the prior art. For example, if the writing time per one scanning electrode is 2.5 microseconds and the number of the scanning electrodes is 500, a total addressing period is 7.5 milliseconds (2.5 microseconds ×500 ×4 +2.5 microseconds ×250 ×4). Therefore, 9.2 milliseconds can be assigned to the sustaining period in one field. This is 1.37 times greater than the 6.7 milliseconds in the prior art. Thus, a 40% increase in the brightness can be obtained.

Figure 2:
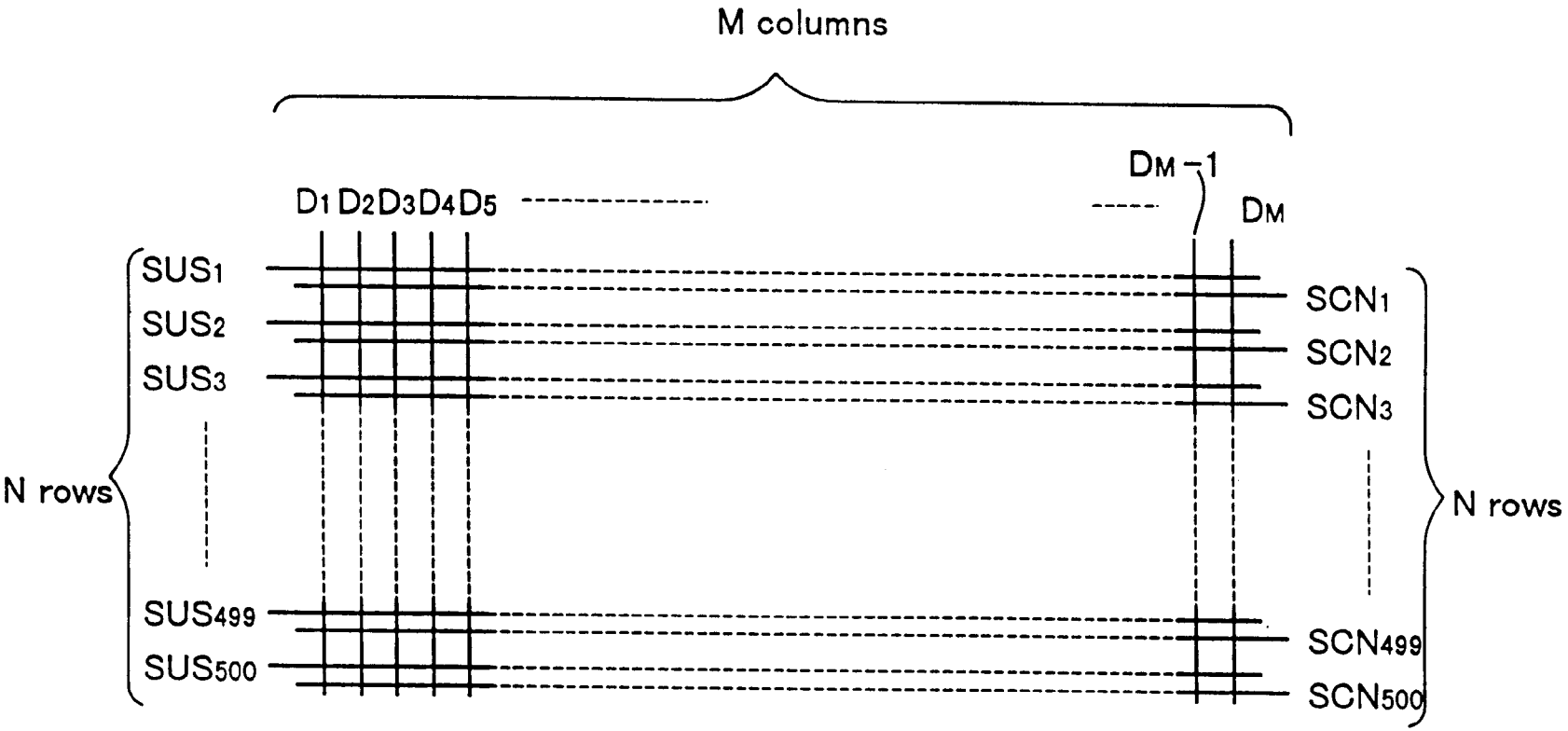
FIG. 2 shows an arrangement of electrodes of a PDP.

The method of driving a PDP for performing the displaying method of the present invention is explained. FIG. 2 shows an electrode arrangement of a PDP, in which M data electrodes $D_1$–$D_M$ extend in the column direction, and 500 scanning electrodes $SCN_1$–$SCN_{500}$ and 500 holding electrodes $SUS_1$–$SUS_{500}$ extend in the row direction. The driving method for this PDP is explained referring to FIGS. 3 and 4.

Figure 3:
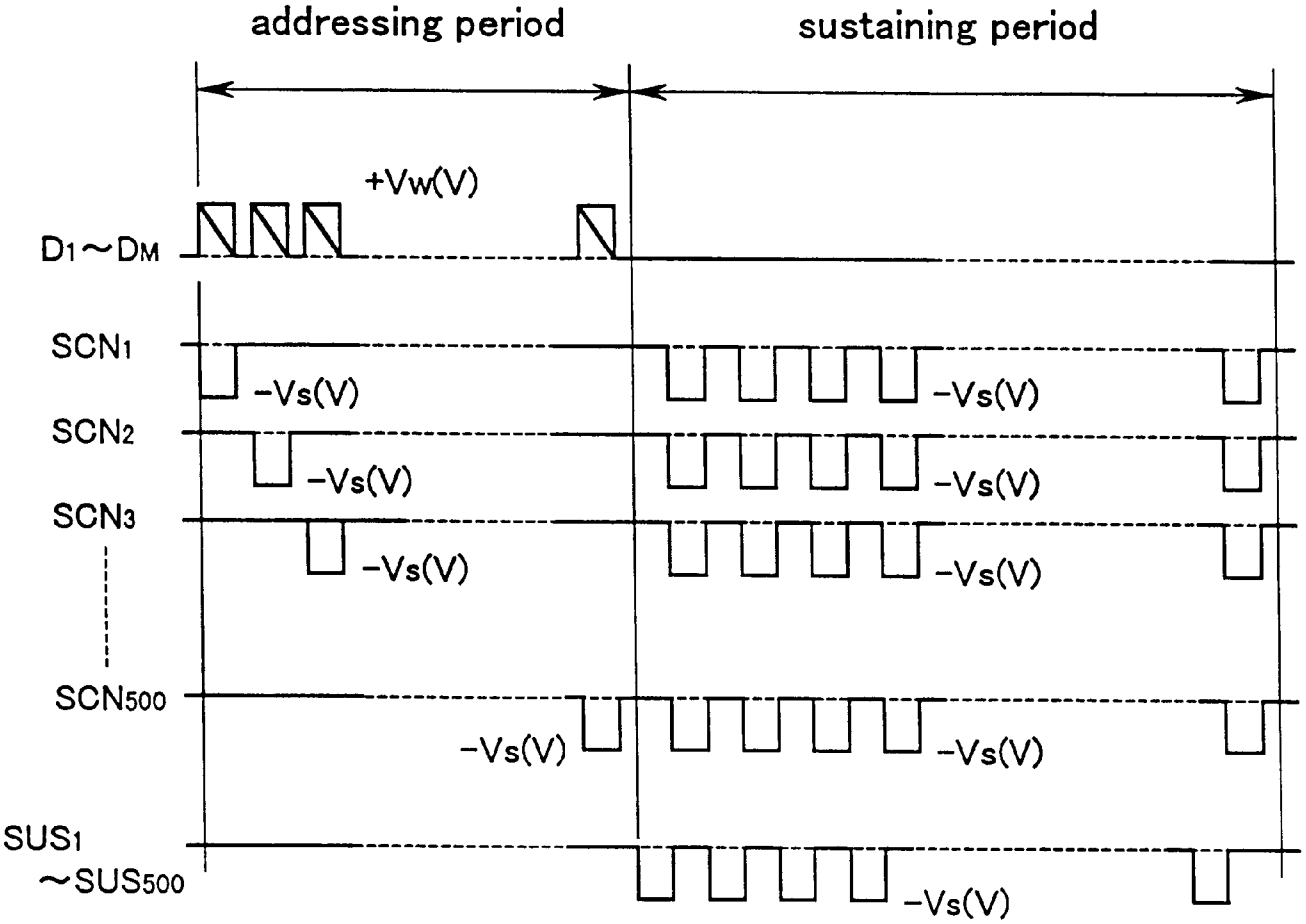
FIG. 3 is a timing chart of a subfield corresponding to an upper four bits.

FIG. 3 is a timing chart of driving signals in the subfield corresponding to the upper four bits. First, in the addressing period, a positive writing pulse whose voltage is +Vw volts is applied to those data electrodes to be written data among the data electrodes $D_1$–$D_M$, and at the same time, a negative scanning pulse whose voltage is −Vs volts is applied to the first scanning electrode $SCN_1$, so that writing discharges occur at the cross points of data electrodes to be written and the first scanning electrode $SCN_1$.

Next, the positive writing pulse (+Vw volts) is applied to the data electrodes to be written data, and at the same time, the negative scanning pulse (−Vs volts) is applied to the second scanning electrode $SCN_2$, so that writing discharges occur at the cross points of data electrodes to be written and the second scanning electrode $SCN_2$.

The above explained operation is performed sequentially, the positive writing pulse (+Vw volts) is applied to the data electrodes to be written data, and at the same time, the negative scanning pulse (−Vs volts) is applied to the 500th scanning electrode $SCN_{500}$, so that writing discharges occur at the cross points of data electrodes to be written and the 500 th scanning electrode $SCN_{500}$. Thus, image data is written into the PDP.

Next, in the sustaining period, a negative sustaining pulse whose voltage is −Vs volts is applied to all of the holding electrodes $SUS_1$–$SUS_{500}$ so as to start sustaining discharges at the points where the writing discharges have occurred. Then, a negative sustaining pulse whose voltage is −Vs volts is applied to all of the scanning electrodes $SCN_1$–$SCN_{500}$.

The writing operation and the sustaining operation are performed alternately so that the sustaining discharge succeeds the writing discharge at the points to be written image data. Thus, the image is displayed.

Figure 4:
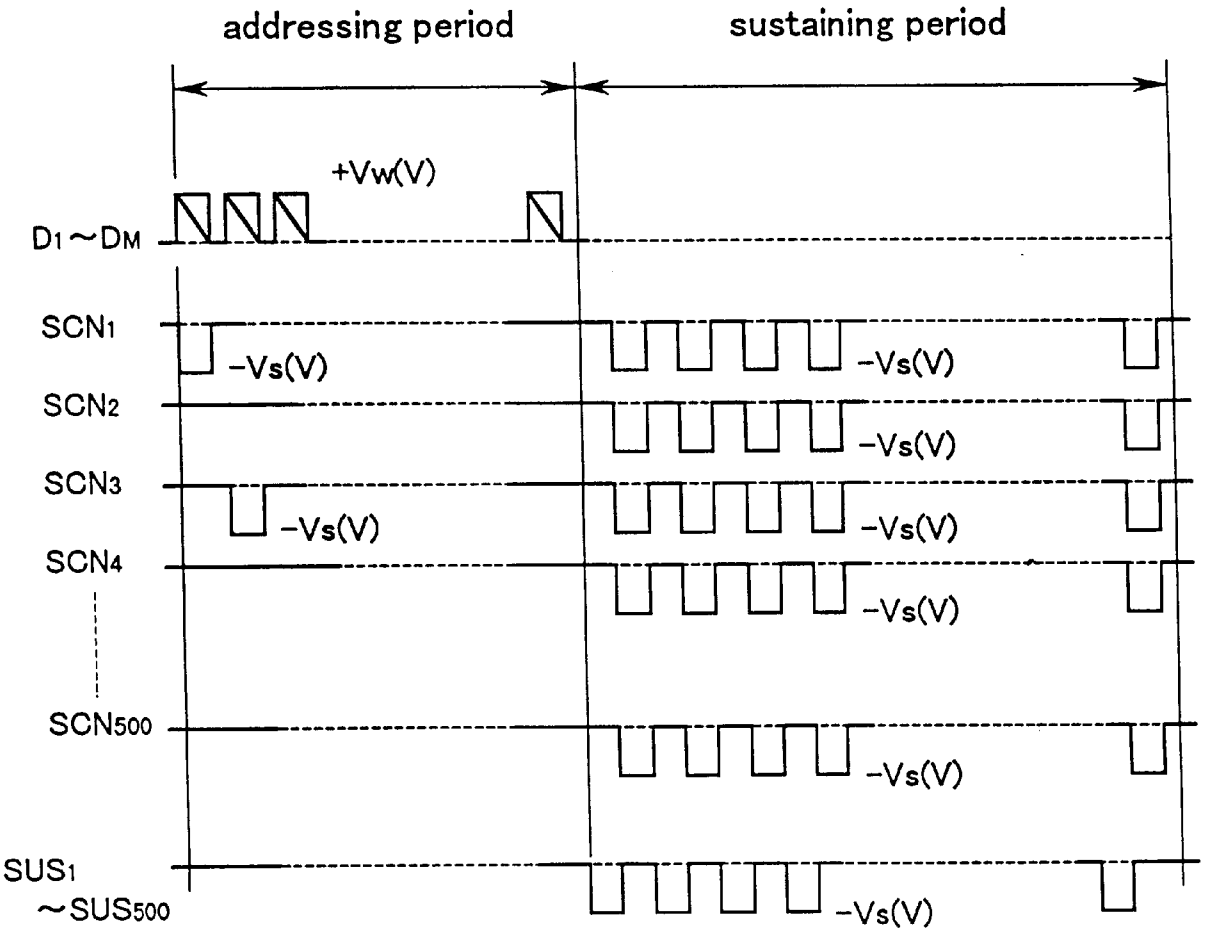
FIG. 4 is a timing chart of a subfield corresponding to the odd bits of the lower four bits.

FIG. 4 is a timing chart of driving signals in the subfield corresponding to the odd bits ($b_1$ and $b_3$) of the lower four bits. First, in the addressing period, a positive writing pulse whose voltage is +Vw volts is applied to those data electrodes to be written data among data electrodes $D_1$–$D_M$, and at the same time, a negative scanning pulse whose voltage is −Vs volts is applied to the first scanning electrode $SCN_1$, so that writing discharges occur at the cross points of data electrodes to be written and the first scanning electrode $SCN_1$.

Next, the positive writing pulse (+Vw volts) is applied to the data electrodes to be written data, and at the same time, the negative scanning pulse (−Vs volts) is applied to the third scanning electrode $SCN_3$, so that writing discharges occur at the cross points of data electrodes to be written and the third scanning electrode $SCN_3$.

As mentioned above, the scanning electrodes are selected alternately to write data in the PDP until the 499 th scanning electrode receives the negative scanning pulse (−Vs volts) and the positive writing pulse (+Vw volts) is applied to data electrodes to be written data so that writing discharges occur at the cross points of data electrodes to be written and the 499 th scanning electrode $SCN_{499}$.

According to the above-mentioned operation, image data are written in the PDP. Then the operation in the sustaining period is performed in the same way as explained referring to FIG. 3.

Figure 5:
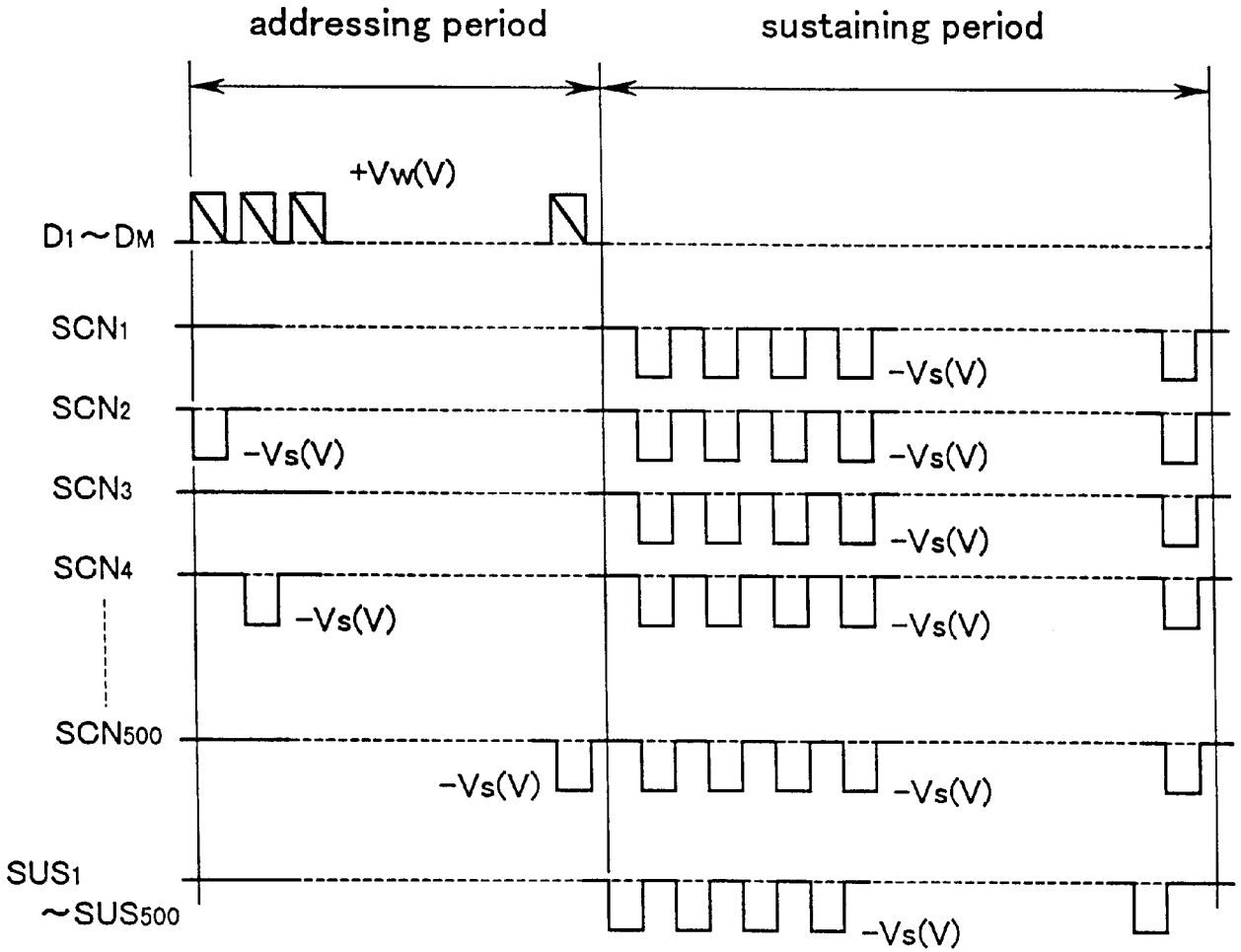
FIG. 5 is a timing chart of a subfield corresponding to the even bits of the lower four bits.

FIG. 5 is a timing chart of driving signals in the subfield corresponding to the even bits ($b_0$ and $b_2$) of the lower four bits. First, in the addressing period, a positive writing pulse whose voltage is +Vw volts is applied to those data electrodes to be written data among data electrodes $D_1$–$D_M$, and at the same time, a negative scanning pulse whose voltage is −Vs volts is applied to the second scanning electrode $SCN_2$, so that writing discharges occur at the cross points of data electrodes to be written and the second scanning electrode $SCN_2$.

Next, the positive writing pulse (+Vw volts) is applied to the data electrodes to be written data, and at the same time, the negative scanning pulse (−Vs volts) is applied to the fourth scanning electrode $SCN_4$, so that writing discharges occur at the cross points of data electrodes to be written and the fourth scanning electrode $SCN_4$.

As mentioned above, the scanning electrodes are selected alternately to write data in the PDP until the 500 th scanning electrode receives the negative scanning pulse (−Vs volts) and the positive writing pulse (+Vw volts) is applied to data electrodes to be written data so that writing discharges occur at the cross points of data electrodes to be written and the 500 th scanning electrode $SCN_{500}$.

According to the above-mentioned operation, image data are written in the PDP. Then the operation in the sustaining period is performed in the same way as explained referring to FIG. 3.

EXAMPLE 2

Figure 6:
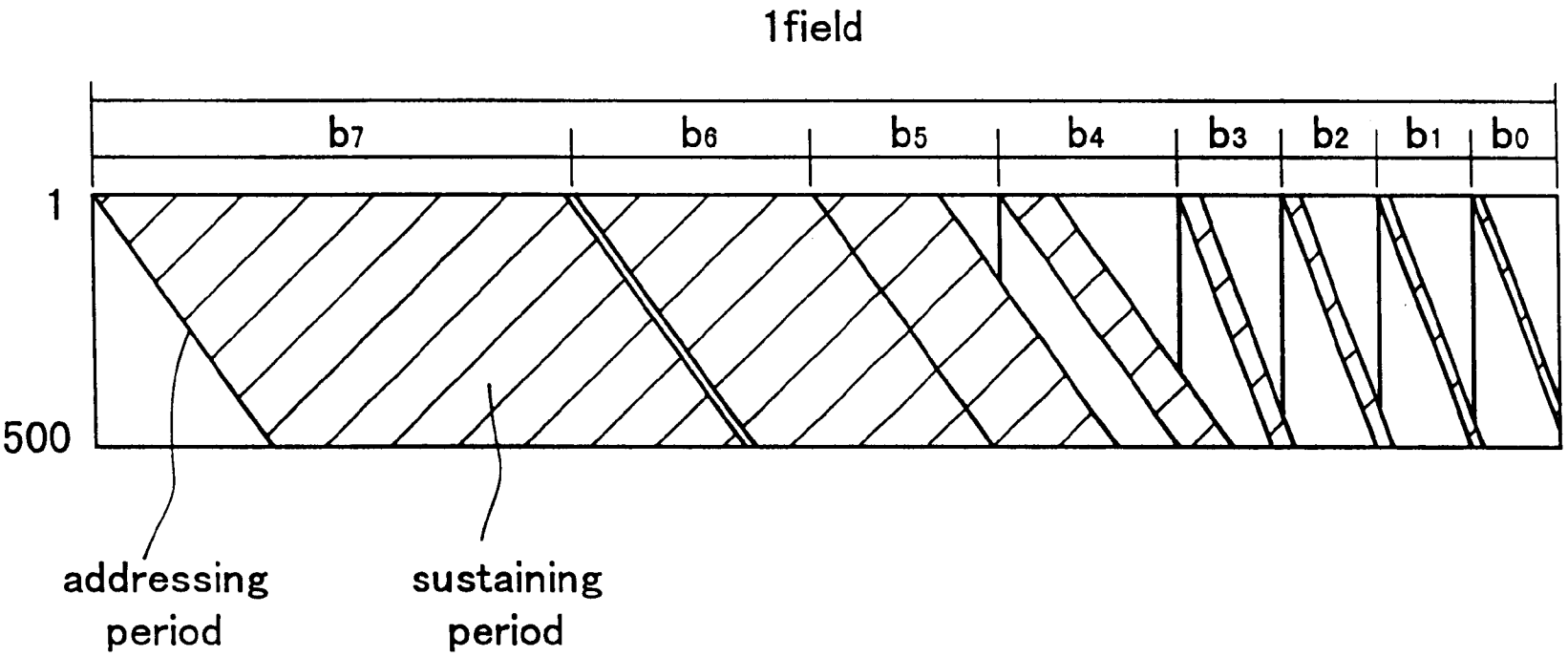
FIG. 6 is a time chart showing another example of the method for displaying gradation according to the present invention.
Figure 7:
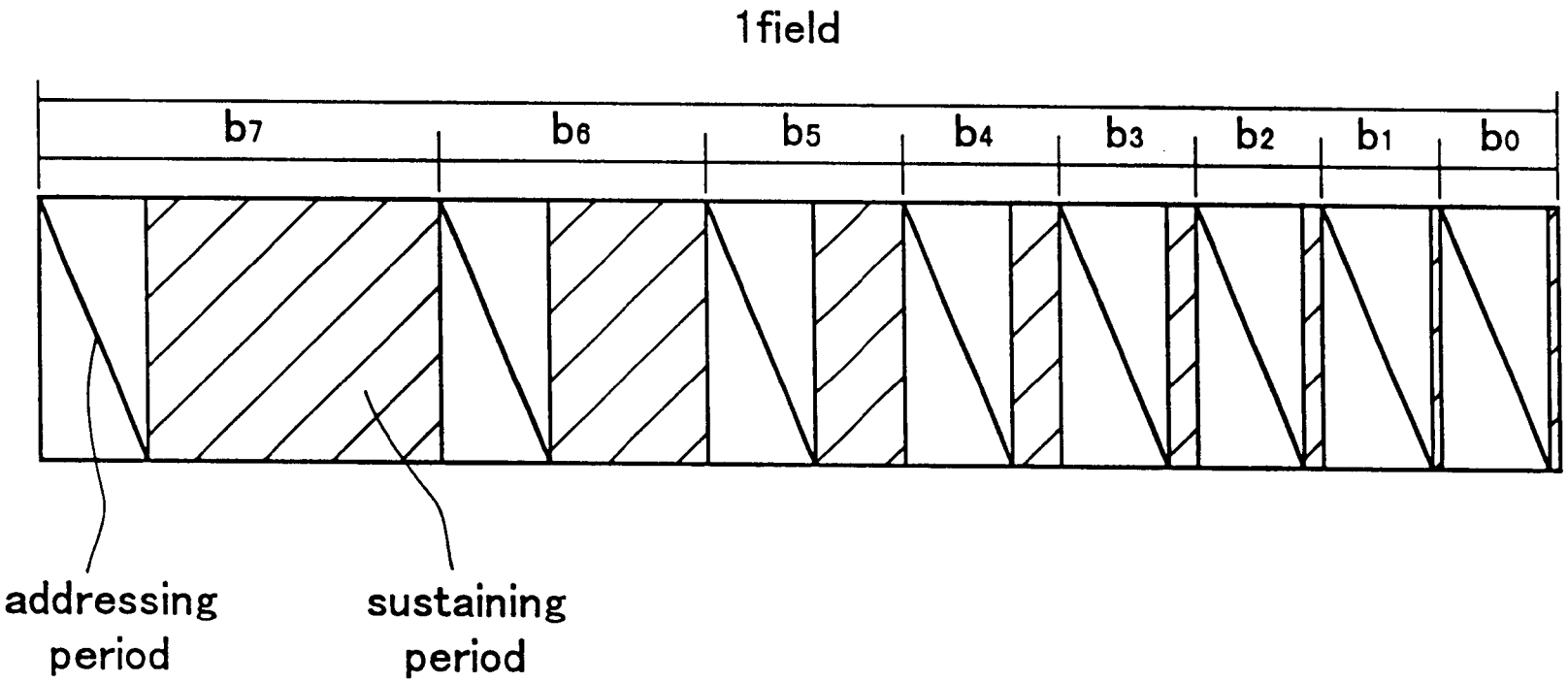
FIG. 7 (PRIOR ART)
FIG. 7 is a time chart showing a method for displaying gradation in the prior art.
Figure 8:
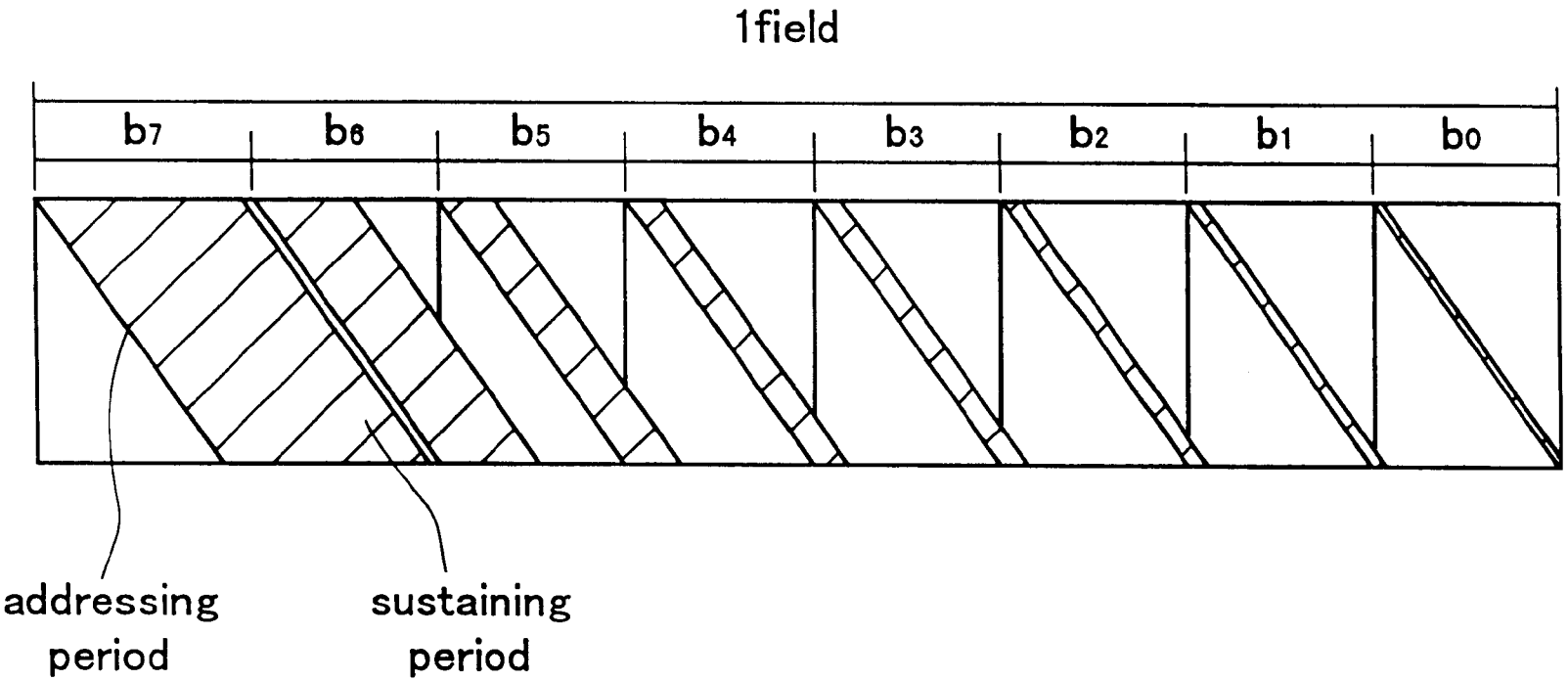
FIG. 8 (PRIOR ART)
FIG. 8 is a time chart showing another method for displaying gradation in the prior art.

Another example of the present invention is explained referring to FIG. 6. In this example, one field is divided into eight subfields, in each of which data is written for one scanning electrode, and at once, the sustaining period starts. The sustaining period of each subfield is given a weight of 128, 64, 32, 16, 8, 4, 2 or 1 corresponding to an 8-bit digital signal ($b_7$, $b_6$, $b_5$, $b_4$, $b_3$, $b_2$, $b_1$, and $b_0$) generated by A/D conversion of an image signal. Then, the image data are written for a scanning electrode sequentially utilizing the sustaining period that is a pulse resting period.

In the subfield corresponding to the upper four bits ($b_4$, $b_5$, $b_6$ and $b_7$), data are written for every scanning electrode. However, data are written for every other scanning electrode in the subfield corresponding to the lower four bits ($b_0$, $b_1$ $b_2$ and b3). In other words, an interlace scanning is performed in the subfield corresponding to the lower four bits. Thus, the period of the subfield corresponding to the upper four bits becomes 1.5 times that of the prior art, resulting in a 40% increase in the brightness.

In the subfield that performs an interlace scanning, the subfield corresponding to the odd bits $b_1$ and $b_3$ may select the odd number of scanning electrodes $SCN_1$, $SCN_3$, . . . , $SCN_{499}$, while the subfield corresponding to the even bits $b_o$ and $b_2$ may select the even number of scanning electrodes $SCN_2$, $SCN_4$. . . , $SCN_{500}$. Thus, every scanning electrode is selected to address in one field.

As an alternative method of interlace scanning, two neighboring scanning electrodes may be selected simultaneously in the subfield that does not perform the non-interlace scanning (i.e., a quasi-whole scanning). Also in this case, the addressing period can be shortened by shifting the two neighboring scanning electrodes by one scanning line for writing data in the same way as the interlace scanning.

The number of the subfield that performs the interlace scanning among the lower bits is not limited to the example explained above, but may be an optimum number depending on the number of the scanning electrodes, the method of giving weight to the subfield, and the characteristics of the PDP.

In a specific subfield, when the interlace scanning or the quasi-whole scanning is performed, the sustaining period of each subfield may be given a weight so as to adjust to the interlace scanning or the quasi-whole scanning beforehand. Thus, a linearity of the brightness in the displayed image can be stable.

The linearity of the brightness can be improved also by compensating an alteration of the brightness due to the interlace scanning or the quasi-whole scanning in a stage processing an image signal beforehand. In addition, by combining this method with the adjustment of the weight given to the sustaining period of the subfield mentioned above, the linearity of the brightness can be improved.

As explained above, the present invention can provide a method for displaying an image in a PDP with an increased brightness by shortening the addressing period, without losing its advantage of little image flicker.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A method for displaying gradation with a plasma display panel, by time-dividing a field of an image into a plurality of subfields, and giving a proper weight on a luminescent period in each subfield, the method comprising the steps of:

forming the field to include a whole scanning subfield and a partial scanning subfield, each of which includes an addressing period to scan scanning electrodes sequentially for writing image data and a sustaining period to hold the written image data, the sustaining period of the partial scanning subfield being shorter than that of the whole scanning subfield;

scanning all of the scanning electrodes one by one in the addressing period of the whole scanning subfield; and scanning some of the scanning electrodes in the addressing period of the partial scanning subfield.

2. The method according to claim 1, wherein the scanning electrodes with either an odd number or an even number are scanned in the partial scanning subfield, supposing that the scanning electrodes are sequentially arranged.

3. The method according to claim 2, wherein the partial scanning subfield in which the scanning electrodes with an odd number are scanned and the partial scanning subfield in which the scanning electrodes with an even number are scanned appear alternately.

4. The method according to claim 1, wherein the whole scanning subfield is a subfield corresponding to the highest brightness signal.

5. A method for displaying gradation with a plasma display panel, by time-dividing a field of an image into a plurality of subfields, and giving a proper weight on a luminescent period in each subfield, the method comprising the steps of:

forming the field to include a whole scanning subfield and a quasi-whole scanning subfield, each of which includes an addressing period to scan scanning electrodes sequentially for writing image data and a sustaining period to hold the written image data, the sustaining period of the quasi-whole scanning subfield being shorter than that of the whole scanning subfield;

scanning all of the scanning electrodes one by one in the addressing period of the whole scanning period; and scanning all of the electrodes by selecting two neighboring scanning electrodes simultaneously in the addressing period of the quasi-whole scanning subfield.

6. The method according to claim 5, wherein data corresponding to the scanning electrode with either an odd number or an even number are written in the quasi-whole scanning subfield supposing that the scanning electrodes are sequentially arranged.

7. The method according to claim 6, wherein the quasi-whole scanning subfield in which the data corresponding to the scanning electrode with an odd number are written and the quasi-whole scanning subfield in which the data corresponding to the scanning electrode with an even number are written appear alternately.

8. The method according to claim 5, wherein the whole scanning subfield is a subfield corresponding to the highest brightness signal.

* * * * *